US011465062B2

(12) United States Patent
Ahle

(10) Patent No.: US 11,465,062 B2
(45) Date of Patent: Oct. 11, 2022

(54) FAIRGROUND RIDE PASSENGER UNIT

(71) Applicant: Hawe Altenstadt holding GMBH, Altenstadt (DE)

(72) Inventor: Alexander Ahle, Worth an der Donau (DE)

(73) Assignee: Hawe Altenstadt Holding GmbH, Altenstadt (DE)

( * ) Notice: Subject to any disclaimer, the term of this patent is extended or adjusted under 35 U.S.C. 154(b) by 162 days.

(21) Appl. No.: 16/628,957

(22) PCT Filed: May 29, 2019

(86) PCT No.: PCT/EP2019/064095
§ 371 (c)(1),
(2) Date: Jan. 6, 2020

(87) PCT Pub. No.: WO2019/229183
PCT Pub. Date: Dec. 5, 2019

(65) Prior Publication Data

US 2021/0069603 A1 Mar. 11, 2021

(30) Foreign Application Priority Data

Jun. 1, 2018 (DE) ..... 102018113125.9

(51) Int. Cl.
*A63G 7/00* (2006.01)
*B60R 21/00* (2006.01)

(52) U.S. Cl.
CPC ..... *A63G 7/00* (2013.01)

(58) Field of Classification Search
CPC ..... A63G 7/00; A63G 31/00; B60R 21/00; B60R 21/02; F15B 15/26
(Continued)

(56) References Cited

U.S. PATENT DOCUMENTS 4,531,459 A 7/1985 Yamada
5,129,478 A 7/1992 Suenaga et al.
(Continued)

FOREIGN PATENT DOCUMENTS

DE 2518715 A1 9/1976
DE 3237684 A1 4/1983
(Continued)

OTHER PUBLICATIONS

International Search Report dated Sep. 26, 2019; International Application No. PCT/EP2019/064095.

*Primary Examiner* — Kien T Nguyen
(74) *Attorney, Agent, or Firm* — Dinsmore & Shohl LLP

(57) ABSTRACT

A passenger restraint device of a fairground ride passenger unit, having a passenger space, includes a position-adjustable restraint element and a lockable hydraulic adjuster which acts on the restraint element. The lockable hydraulic adjuster has a cylinder-piston unit and a hydraulic accumulator. The hydraulic accumulator and the cylinder-piston unit of the hydraulic adjuster form a structural unit with a cylinder of the cylinder-piston unit and a cylinder of the hydraulic accumulator arranged next to and parallel to each other as part of the integrated cylinder assembly. A common closure cover is provided on each end face of the integrated cylinder assembly. Please replace the specification with the attached substitute specification. A marked-up and clean version of the amended specification is submitted herewith.

16 Claims, 6 Drawing Sheets

(58) Field of Classification Search
USPC ..... 104/76; 472/43, 59–60, 130
See application file for complete search history.

(56) References Cited

U.S. PATENT DOCUMENTS

| | | | | |
|---|---|---|---|---|
| 6,159,061 | A | 12/2000 | Gorokawa | |
| 6,227,121 | B1 | 5/2001 | Mares | |
| 9,744,930 | B2 | 8/2017 | Howard | |
| 9,914,428 | B2 * | 3/2018 | Zamperla | B60R 21/01524 |
| 11,007,960 | B1 * | 5/2021 | Syrcle | F15B 13/044 |
| 2006/0207246 | A1 | 9/2006 | Hindman | |
| 2008/0149017 | A1 | 6/2008 | Blum et al. | |
| 2010/0307288 | A1 | 12/2010 | Lubman et al. | |
| 2015/0152842 | A1 | 6/2015 | Gaile et al. | |
| 2017/0296934 | A1 * | 10/2017 | Checketts | B60N 2/24 |
| 2020/0298783 | A1 * | 9/2020 | Zürcher | B60N 2/24 |

FOREIGN PATENT DOCUMENTS

| | | | |
|---|---|---|---|
| DE | 60117236 | T2 | 9/2006 |
| DE | 202016003163 | U1 | 6/2016 |
| EP | 1912715 | B1 | 1/2011 |
| EP | 3081273 | A1 | 10/2016 |
| WO | 1999021737 | | 5/1999 |
| WO | 2001074626 | A1 | 10/2001 |
| WO | 2006053591 | A1 | 5/2006 |
| WO | 2007136245 | A1 | 11/2007 |

* cited by examiner

FAIRGROUND RIDE PASSENGER UNIT

CROSS-REFERENCE TO RELATED APPLICATIONS

This application is the U.S. national stage of PCT/EP2019/064095 filed May 29, 2019, which claims priority of German Patent Application 10 2018 113 125.9 filed Jun. 1, 2018 both of which are hereby incorporated by reference in their entirety.

FIELD OF THE INVENTION

This invention relates to a fairground ride passenger unit. In particular, the present invention relates to a fairground ride passenger unit having passenger space and a passenger restraint device, wherein the passenger restraint device comprises a position-adjustable restraint element and a lockable hydraulic adjuster acting thereon, which in turn comprises a cylinder-piston unit and a hydraulic accumulator.

BACKGROUND OF THE INVENTION

For safety reasons, passenger restraint devices are provided in particular for rides used for the amusement of persons, in which very considerable forces or accelerations are exerted on the persons concerned (passengers), by means of which the passengers are fixed to the passenger space occupied by them in such a way that they cannot leave this passenger space (seat, lying surface, standing area, etc.). Depending on the individual ride, the passenger restraint device also further restricts the passenger's freedom of movement (immobilization). With regard to the prior art, reference is made, for example, to EP 3081273 A1, WO 2007/136245 A1, WO 2006/053591 A1, EP 1912715 B1, U.S. Pat. Nos. 9,744,930 B2, 4,531,459 A, 5,129,478 A, WO 01/74626 A1, WO 99/21737 A1, US 2010/0307288 A1 and US 2008/0149017 A1.

Common restraint elements are, for example, restraining brackets which are used to fix the passenger on the shoulders, chest, back, belly, hips and/or legs. Such restraining brackets or other restraint elements may, in particular, be pivotally attached to the structure of the passenger unit, which also includes the passenger space, in such a way that they can be locked in several different positions to adapt to the individual height of the passenger concerned.

Conventional locking systems used comprise ratchets or comparable mechanical locking gears. For hydraulic locking elements that are already in use, the locking function is typically based on the fact that hydraulic fluid is tightly locked in a hydraulic cylinder working chamber, the volume of which changes with the position of the restraint element. This allows the restraint element to be infinitely locked in different positions. The hydraulic cylinder may be part of a hydraulic adjuster which, in addition to the blocking or locking function for the restraint element, has a further function in that it is suitable and designed for actively opening the restraint element after it has been unlocked. In this way, the restraining brackets or other restraint elements can be opened simultaneously and without any action on the part of the passengers in all passenger units of the fairground ride by the assigned adjusters, which makes a quick and smooth passenger change possible. In addition to the—then typically double-acting—hydraulic cylinder, the adjuster also comprises a hydraulic accumulator which stores hydraulic fluid under pressure, is charged by hydraulic fluid displaced from the hydraulic cylinder when the restraint element is closed, and—when the valve is in the appropriate position—acts in the reverse direction of flow on the hydraulic cylinder in the sense of opening the restraint element.

SUMMARY OF THE INVENTION

The problem solved by the present invention is to provide a further improvement of the above-mentioned state of the art in terms of safety.

This problem is solved in accordance with the invention, by the fact that in a fairground ride passenger unit in which the hydraulic accumulator and the cylinder-piston unit of the hydraulic adjuster form a structural unit in that the cylinder of the cylinder-piston unit and a cylinder of the hydraulic accumulator arranged next to and parallel to it are part of an integrated cylinder assembly which comprises a common closure cover on both end faces respectively. According to the invention, fairground ride passenger units can be realized in which the hydraulic adjuster is absolutely compact despite the provision of high locking forces. One of the factors here is that the hydraulic accumulator has a cylinder extending parallel to the cylinder of the cylinder-piston unit and at least substantially over its entire length. This allows the hydraulic accumulator to be comparatively slim. Thanks to its compact design, the hydraulic adjuster can be ideally accommodated within the passenger unit in terms of safety, i.e. in a place where it is optimally protected from damage that could impair its function and reliability, while at the same time minimizing the risk of injury to the passenger due to both its small size and the possibility of optimal accommodation. The possibility of comparatively closed construction, i.e. the absence of protruding parts and/or gaps in which objects can get caught, also contributes to this.

Furthermore, the hydraulic adjuster of the passenger unit according to the invention is particularly suitable for a modular design due to its structural features. For example, mirror-image adjusters can be made available with very little effort. The same applies to adjusters which differ only with regard to the piston locking direction (i.e. locking against retraction or against extension of the piston rod with free movement in the opposite direction), but which are otherwise identical. Furthermore, due to this, it is possible to retrofit from one version to another by simple and uncomplicated adaption of the adjusters.

The hydraulic accumulator used by the hydraulic adjuster of the invention passenger unit—as part of an integrated cylinder assembly also comprising the cylinder of the cylinder-piston unit—may be designed as a spring accumulator in the preferred configuration in such a way that the hydraulic fluid stored in its cylinder is kept under pressure by means of a spring, the hydraulic chamber storing the hydraulic fluid and the spring chamber containing the spring being separated from each other by a separating element. As a spring, various devices can be considered which are suitable for absorbing, storing and releasing energy. If the spring is realized by a mechanical spring (e.g. coil spring), the separating element is preferably designed as a piston. Even if the spring is realized by a gas spring, the separating element is preferably formed by a piston. This means that the comparatively elongated design of the hydraulic accumulator can be used to optimum effect as a result of its particularly slim cylinder (see above). Alternatively, however, it may be advantageous if an elastically flexible bladder filled with the pressurized spring gas is accommodated inside the cylinder of the hydraulic accumulator.

According to a particularly preferred further embodiment of the invention, the cylinder assembly of the hydraulic adjuster comprises a portion of an extruded double-tube profile. The cylinder-piston unit and the cylinder of the hydraulic accumulator are mutually stiffened, so that the cylinder-piston unit can withstand without damage even when subjected to particularly strong or violent mechanical stresses, and this at a particularly low weight, which in turn proves to be very advantageous in view of the sometimes very considerable acceleration forces to which the elements of the passenger restraint device are exposed. However, as an alternative to the use of a double-tube profile described above, the use of two separate tube profiles clamped between the two common closure covers for the cylinder of the cylinder-piston unit, on the one hand, and the cylinder of the hydraulic accumulator, on the other hand, may prove to be very advantageous. Here, too, a considerable amount of mutual static stiffening of the two tube profiles is achieved by means of the two common closure covers, with the positive result described above. In addition, this design favors the modular concept already emphasized above through the combinability of different and separate tube profiles.

To allow for a particularly low weight, but in particular also because of a very advantageous operating characteristic of the adjuster, it is also preferable if the hydraulic accumulator comprises a gas spring, i.e. the spring space preferably delimited by a piston or a bladder arrangement accommodates a compressed gas filling in a gas-tight manner, the gas spring having the further advantage that its operating characteristic is only minimally influenced by the changing position or orientation in the space and/or the strongly and rapidly changing kinetic conditions.

According to another preferred further embodiment of the invention, a switching plate is provided on the front side of the cylinder assembly having a line and valve arrangement hydraulically interconnecting the hydraulic accumulator with the cylinder-piston unit as well as an electrical switching interface. If the hydraulic accumulator is designed as a spring accumulator, in particular as a gas-spring piston accumulator or gas-spring bladder accumulator, the hydraulic chamber of the hydraulic accumulator is particularly preferred to be adjacent to the switching plate and the spring chamber of the hydraulic accumulator is located at a distance from the switching plate. In particular, the cylinder-piston unit can be configured as a differential cylinder and, in an unlocked floating position, both the piston working chamber and the piston rod working chamber of the differential cylinder can be pressurized from the hydraulic accumulator via the line and valve arrangement. The fact that in this case only the differential volume is exchanged with the hydraulic accumulator further favors the possibility of a particularly compact design of the hydraulic adjuster.

The above-mentioned line and valve arrangement accommodated in the switching plate preferably comprises at least one non-return valve which in a safety position allows flow from the piston working space of the differential cylinder to its piston rod working space, but prevents flow in the opposite direction. The restraint element can thus be operated intuitively by manually moving it towards the passenger's body until it is securely fixed, and the restraint element then easily remains in this position due to the said non-return valve operating in the safety position. Such intuitive operation is also an important aspect that promotes safety. Particularly advantageous are those line and valve arrangements in which the safety function described is guaranteed by exactly one, i.e. a single, non-return valve, not only in terms of costs and installation space, but also in terms of safety.

Furthermore, according to another preferred embodiment, the line and valve arrangement may include a check valve arrangement which, in a blocking position with the piston of the differential cylinder being extended, locks hydraulic fluid in the differential cylinder. In this case, in its fully open—and blocked—position, the restraint element is suitable as a boarding and/or alighting aid to provide the passenger with support. Accidents that were caused in the past by a passenger reaching for the restraining bracket or other restraint element when getting on or off the passengers space in the belief that it was making a stop, but giving way to it, can thus be avoided.

Another preferred further embodiment of the present invention is characterized by the fact that the adjuster comprises a piston position sensor. A piston position signal generated by the piston position sensor can be evaluated in various ways in an electronic circuit communicating with the piston position sensor via a control interface such as a SPI bus. In particular, the direct monitoring of the piston of the cylinder-piston unit of the adjuster by means of the piston position sensor and the evaluation circuit to determine whether its position within the cylinder remains the same or changes is a further substantial increase in safety. A (slight) leakage of the valve causing the locking of hydraulic fluid in the cylinder-piston unit can lead to a creeping piston movement; while this remains undetected in the case of monitoring the switching position of the valve concerned, the direct monitoring of the piston position by means of a piston position sensor described above is able to identify this safety deficiency immediately.

A preload of the adjuster implemented by the hydraulic accumulator and acting in the sense of opening the restraint element causes the piston to move in a defined manner by the cylinder-piston unit of the adjuster in the event of a malfunction of the locking function of the adjuster, which is conducive to the reliable, safe detection of such a malfunction by evaluating piston position signals. Appropriate measures can be taken to ensure that deliberate manipulation (in particular by holding the restraint element) is impossible.

In a particularly preferred embodiment, the piston position sensor has a spindle extending parallel to the cylinder axis and mounted so as to be axially fixed but rotatable relative to the cylinder, with a threaded section extending into in a cavity of the piston and having a steep thread, which interacts with a corresponding spindle nut arranged on the piston. An axial movement of the piston causes the spindle to rotate. By means of a sensor, which is preferably configured as a non-contact rotary encoder, such rotation of the spindle is detected. A change in the piston position can thus be reliably detected by means of a particularly compact device.

The evaluation circuit preferably is a structural component of the adjuster, but can also be provided remotely if necessary and can, but does not necessarily have to constantly determine the absolute position of the piston relative to the cylinder of the cylinder-piston unit. Rather, it is sufficient to limit oneself to monitoring only a possible movement of the piston relative to the cylinder of the cylinder-piston unit independent of the respective absolute position; and also such a movement monitoring can be limited to certain times or time ranges within the respective operating cycle of the fairground ride, whereby an evaluation can be omitted particularly during the passenger change. Monitoring aimed at detecting piston movements takes account of the fact that the individual position in which the restraint element must remain fixed by the adjuster during the relevant travel cycle may change from travel cycle to travel cycle because, for example, it depends on the body dimensions of the passenger concerned. The information as to whether and if so how (during the evaluation cycle or the evaluation phases) the piston of the cylinder-piston unit moves relative to its cylinder or not can be derived in various ways from the piston position signal, such as by comparison of clocked piston position signals, by determining the piston speed by differentiation (derivation) of the continuously detected piston position signal after time, by determining the piston acceleration by double differentiation (derivation) of the continuously detected piston position signal after time, or the like.

The evaluation of the piston position signal may also refer to the direction of movement of the piston relative to the cylinder of the cylinder-piston unit—in particular via the direction of rotation of the above-mentioned spindle—if necessary; a further pulling of the restraint element by the passenger to his body in order to ensure an even better fixation in or at the passenger seat is to be judged fundamentally differently from a movement of the restraint element in the opposite direction, i.e. a (creeping) opening of the restraint element.

If, however, the evaluation circuit not only determines possible movements of the piston of the cylinder-piston unit during operation of the ride, but also processes information on the absolute position of the piston, it is possible—as an additional safety aspect—to check whether the respective restraint element in all passenger units of the fairground ride is in a closed position at the beginning of the respective ride cycle (within a bandwidth taking into account the typical body dimensions of passengers).

According to another preferred embodiment of the invention, the piston position sensor communicates with an operating data memory in such a way that piston position signals are stored there and can be retrieved. In accordance with a preferred embodiment, the operating data memory is a structural part of the respective adjuster. However, a central operating data memory may also be considered, in which the operating data of several adjusters of the respective fairground ride are stored. From the data stored in the operating data memory, for example, the individual number of uses of the respective passenger unit can be recorded. This allows service, maintenance and care work to be carried out on the individual passenger unit depending on the intensity of use, which is advantageous both from the point of view of costs and safety. On the one hand—due to the consideration of the actual intensity of use—it is not necessary to carry out service, care and maintenance work as a precautionary measure triggered by a theoretical maximum use of the respective passenger unit. On the other hand, there is no risk of the necessary work being delayed beyond the time scheduled in the maintenance plan—based on a theoretical maximum use—by the ride operator, convinced that this was justified by a significantly lower actual use of the passenger unit than the theoretical maximum use.

Further advantageous aspects and features result from the following explanation of preferred embodiments.

BRIEF DESCRIPTION OF THE DRAWINGS

In the following, this invention will be explained in more detail using three preferred execution examples illustrated in the drawing. Thereby

DETAILED DESCRIPTION OF THE INVENTION

Figure 1:
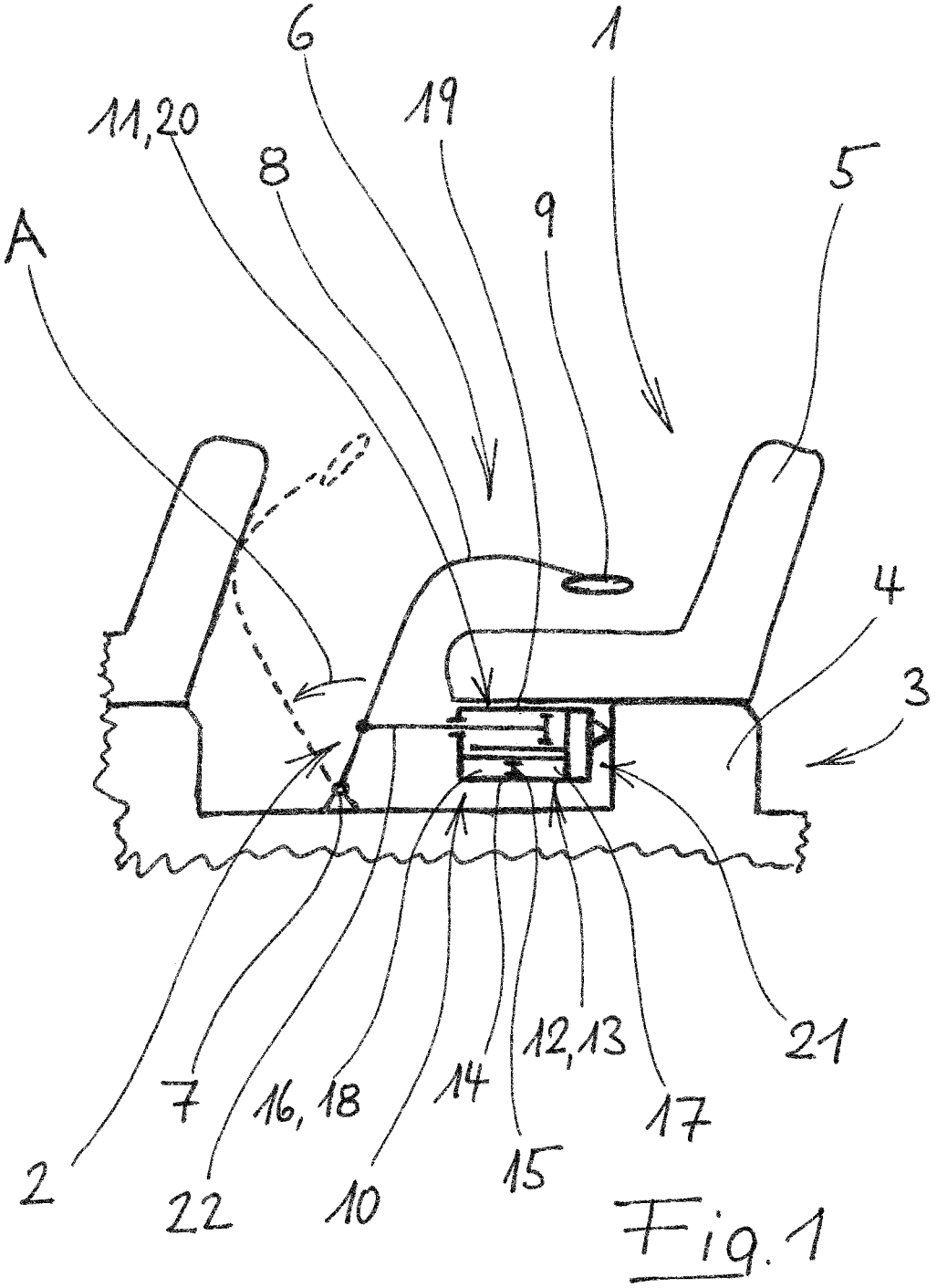
FIG. 1 is a basic representation of a fairground ride passenger unit according to the present invention.

The fairground ride passenger unit partially illustrated only schematically in FIG. 1 comprises a passenger space 1 and a passenger restraint device 2. The passenger space 1 is designed as a seat 5 mounted on a base structure 3 of the fairground ride, namely a seat carrier 4. And the passenger restraint device 2 comprises a position-adjustable restraint element 6 in the form of a restraining bracket 8 pivotably mounted on the base structure 3 of the ride at a joint 7 (cf. arrow A) with a padded pressure plate 9, by means of which a passenger seated on the seat 5 is fixed on the seat 5 at the thighs near the hip.

A lockable hydraulic adjuster 10 acts on the restraining bracket 8. It comprises a cylinder-piston unit 11 and a hydraulic accumulator 12. The hydraulic accumulator 12 is configured as a spring-piston accumulator 13. It comprises a cylinder 14 with a sealingly guided free piston 15, which separates a spring chamber 16 from a hydraulic chamber 17 within the cylinder 14, whereby the spring is configured as a gas spring and the spring chamber 16 is thus configured as a gas chamber 18. The cylinder 19 of the cylinder-piston unit 11, which is configured as a differential cylinder 20, is arranged next to the cylinder 14 of the spring-loaded piston accumulator 13 and parallel to it. The spring-loaded piston accumulator 13 and the cylinder-piston unit 11 form a structural unit in that the cylinder 19 of the cylinder-piston unit 11 and the cylinder 14 of the spring-loaded piston accumulator 13 are part of an integrated cylinder assembly 21. The piston rod 22 of the cylinder-piston unit 11 is hinged to the restraining bracket 8. Opposite the cylinder assembly 21 is hinged to the seat carrier 4.

Figure 2:
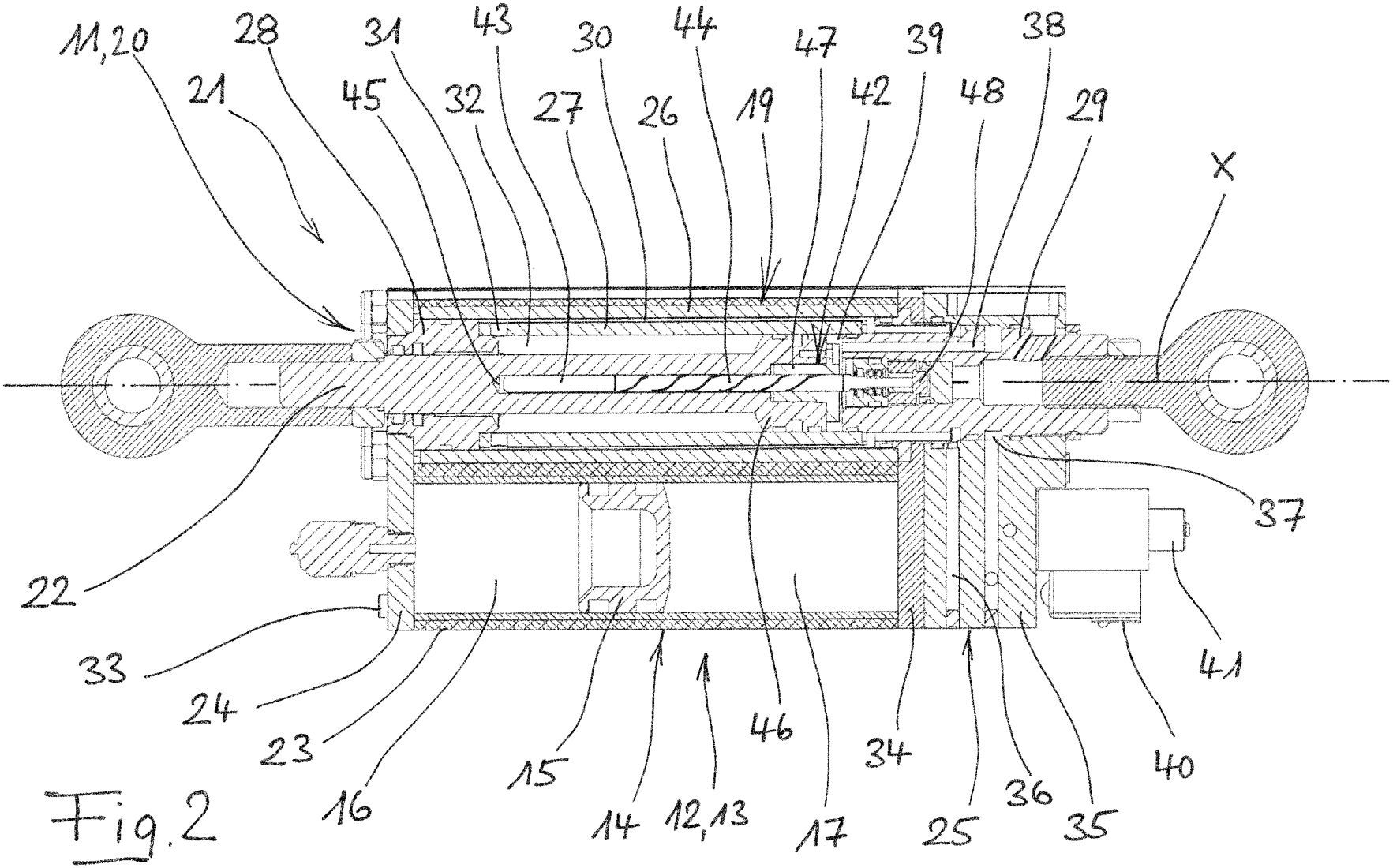
FIG. 2 is a detailed cross section of the hydraulic adjuster used on the fairground ride passenger unit.

Details of cylinder assembly 21 are shown in FIG. 2. The cylinder 14 of the spring-loaded piston accumulator 13 is defined by a cylinder tube 23 which comprises a guide bushing for the piston 15 inserted into one of the two tube sections of an extruded double-tube profile and which is clamped between the two closure covers 24 and 25 closing the spring chamber 16 and the hydraulic chamber 17 respectively. These closure covers 24 and 25 also extend over the end faces of cylinder 19 of cylinder-piston unit 11. The cylinder 19 of the cylinder-piston unit 11 is of double-tube design with an outer tube 26 and an inner tube 27, a head part 28 and a bottom part 29, whereby there is an annular space 30 between the inner tube 27 and the outer tube 26, which communicates with the piston rod working space 32 via bores 31 of the inner tube 27. The cylinder 19 of the cylinder-piston unit 11, as well as the cylinder tube 23 of the spring-loaded piston accumulator 13, is clamped between the two closure covers 24 and 25. The unit is clamped by means of tie rods 33.

The closure cover 25 closing the hydraulic chamber 17 of the spring-loaded piston accumulator 13 comprises in addition to the actual end plate 34 a switching plate 35 with an integrated line and valve arrangement that hydraulically connects the hydraulic chamber 17 of the hydraulic accumulator 12 with the cylinder-piston unit 11. The channels 36 of the line and valve arrangement communicate via corresponding transfers 37 with channels 38 provided in the bottom part 29, the bottom part 29 penetrating the switching plate 35, and the channels 38 lead into the piston working chamber 39 or the annular chamber 30 respectively. The switching plate 35 also has an electrical switching interface 40, via which the switching solenoids 41 of the switching valves integrated in the line and valve arrangement (see FIG. 3) can be controlled.

Furthermore, the cylinder assembly 21 has an integrated piston position sensor 42. It comprises a spindle 43 extending parallel to the cylinder axis X and mounted so as to be axially fixed but rotatable relative to the cylinder 19, with a threaded section 44 having a steep thread, which is extending into a cavity 45 of the piston 46 or the piston rod 22. The threaded section 44 interacts with a corresponding spindle nut 47 located on the piston 46 in such a way that a linear movement of the piston 46 along the axis X is converted into a rotation of the spindle 43 about its axis. To monitor this spindle rotation, a transducer 48 is disposed in the cylinder 19, namely in its bottom part 29. The signal provided by the transducer 48, which is configured as a non-contact rotary transducer, is transmitted to an electrical control interface connected to it. This is connected to an (not shown) electronic evaluation circuit which is also housed in the circuit board 35 and which also includes a readable operating data memory.

Figure 3:
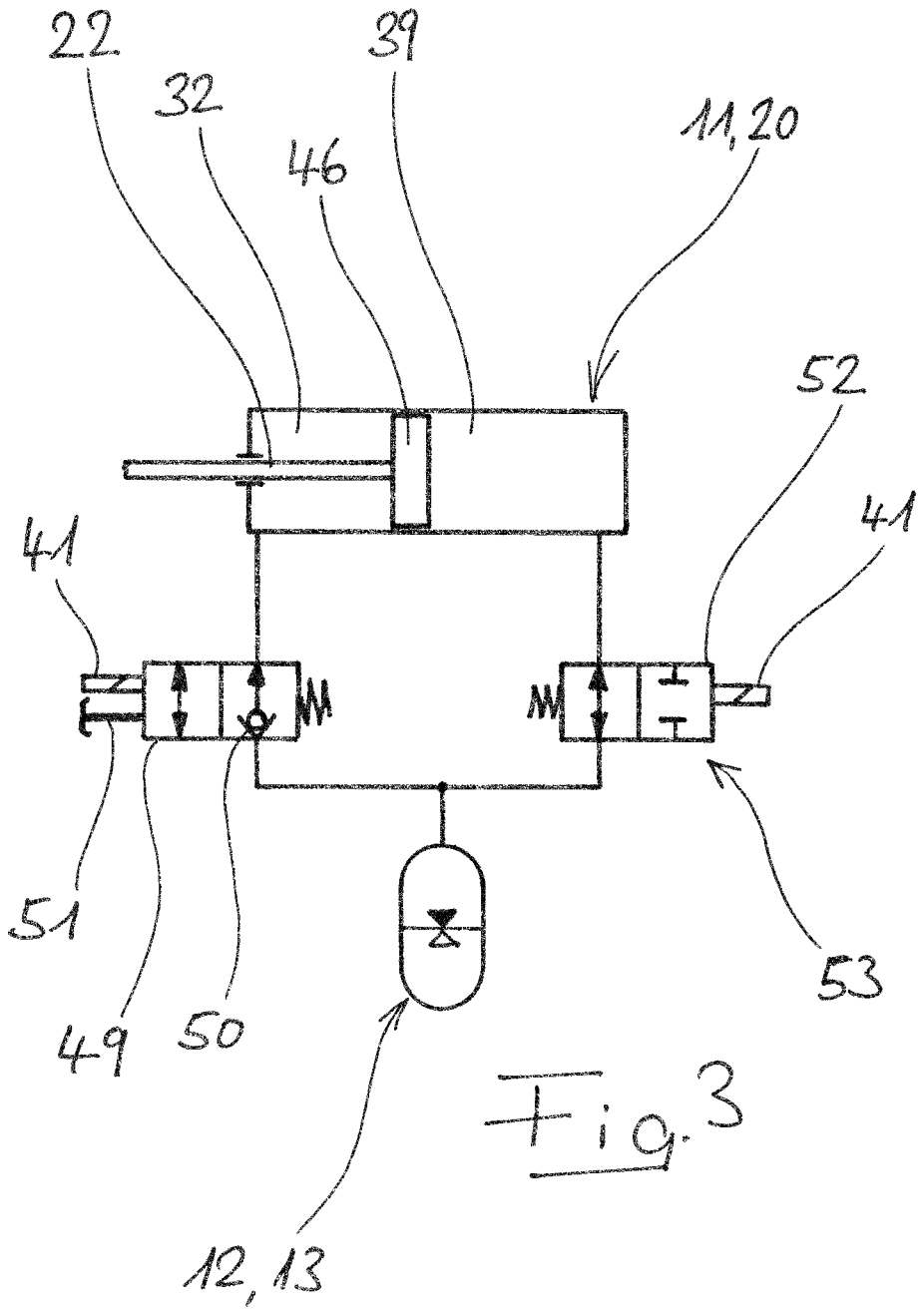
FIG. 3 is a hydraulic circuit diagram for the hydraulic adjuster shown in FIG. 2.

According to the hydraulic circuit diagram shown in FIG. 3, a switching valve 49 configured as a 2/2-way valve is arranged fluidically between the hydraulic accumulator 12 and the piston rod working space 32. In case the switching solenoid 41 is not energized, the switching valve 49 assumes the safety position illustrated in FIG. 3, in which a non-return valve 50 permits a flow from the piston working space 39 of the differential cylinder 20 to its piston rod working space 32, but prevents it in the opposite direction. In this safety position, the restraining bracket 8 can therefore be moved closer to the seat 5, but not further away from it. The switching valve 49 can be switched to its second position by energizing the switching solenoid 41 assigned to the switching valve 49 and in an emergency also by manual actuation using the lever 51. The second position is an unlocked floating position in which both the piston working chamber 39 and the piston rod working chamber 32 of the differential cylinder 20 are pressurized via the line and valve arrangement from the hydraulic accumulator 12. In this floating position and in absence of external forces a force is applied to the restraining bracket 8 to open it. In the floating position, however, the restraining bracket 8 can be moved manually in the direction of its closed position against the relevant opening force.

The line and valve arrangement also includes a second switching valve 52, also in the form of a 2/2-way valve, which can be actuated by means of an associated switching solenoid 41, which forms a check valve arrangement 53 by means of which hydraulic fluid can be locked in the differential cylinder when the respective switching solenoid is energized, thereby blocking the differential cylinder 20, i.e. fixing the position of the piston rod 22. Due to the resulting fixation of the restraining bracket 8 in its position, especially in its fully open position, the restraining bracket 8 can serve as a boarding aid.

Figure 4:
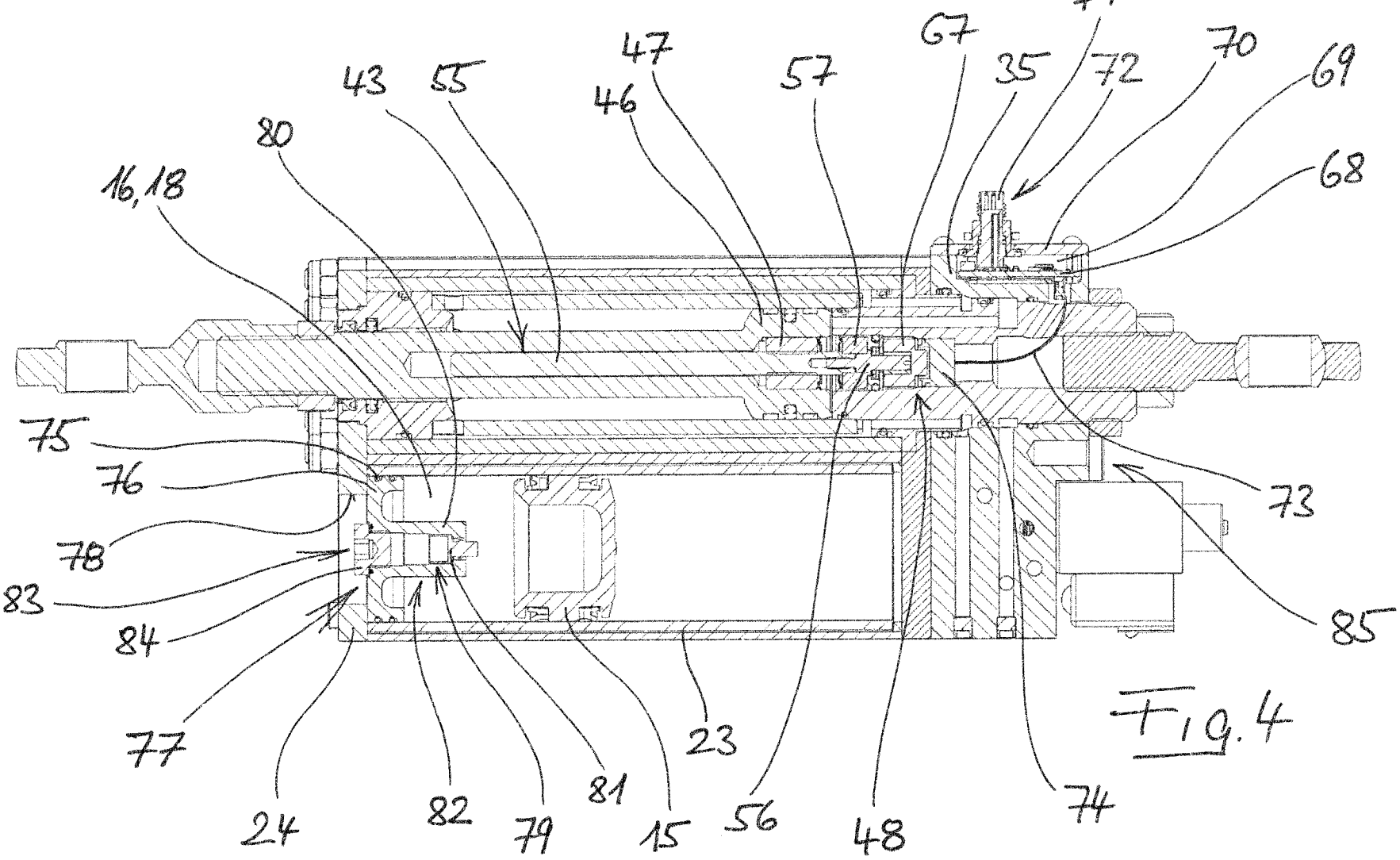
FIG. 4 is a cross section of a hydraulic adjuster modified from the one shown in FIG. 2.
Figure 4A:
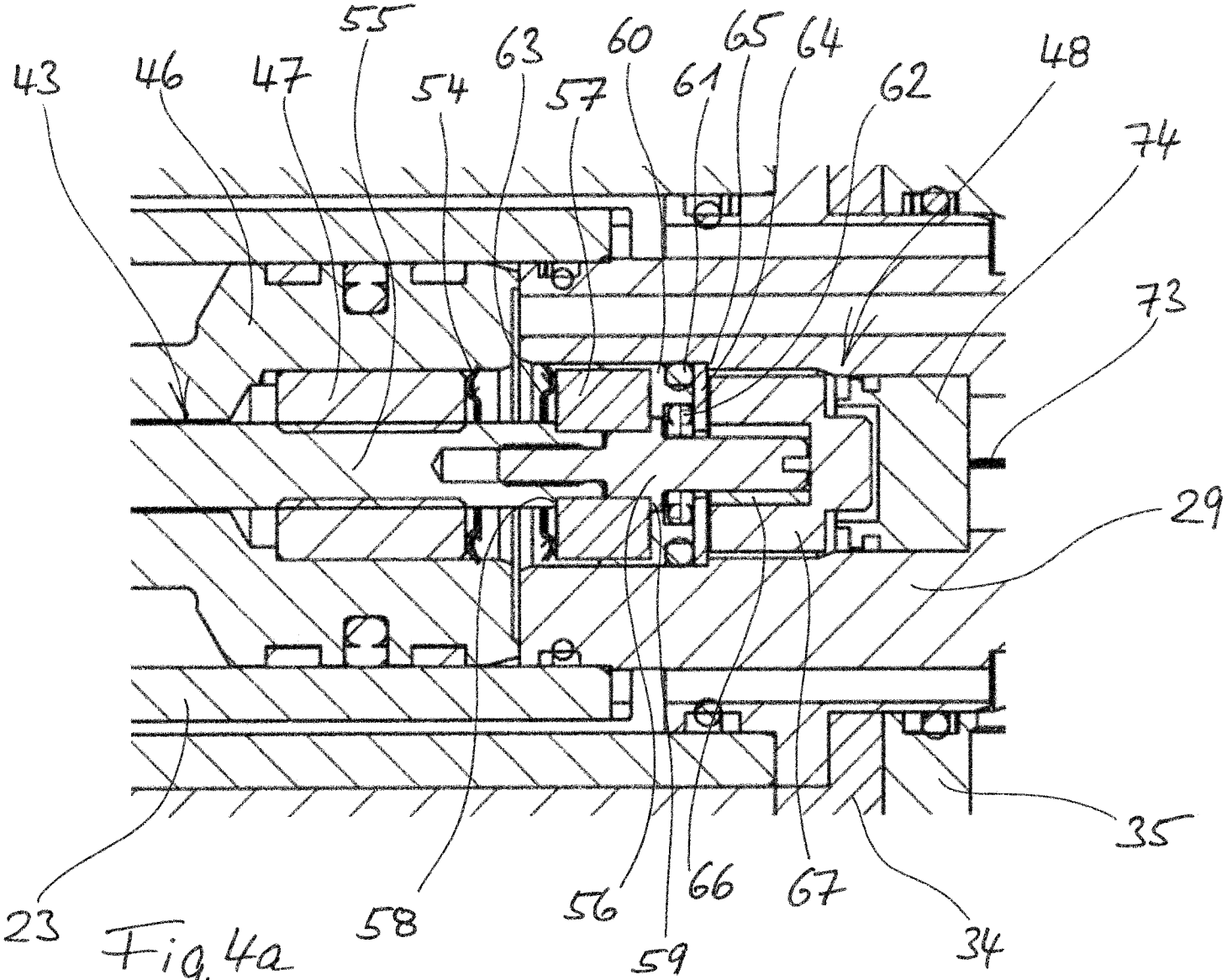
FIG. 4*a* is an enlarged section from FIG. 4 showing details of the respective hydraulic adjuster.

The second exemplary embodiment illustrated in FIGS. 4 and 4*a* corresponds to that in FIG. 2 with regard to basic features, so that reference is made to the previous explanations in order to avoid repetitions. However, by implementing several design deviations from the first example shown in FIG. 2 and described above, which are explained below, it is especially designed for applications in which particularly high forces have to be provided in a very compact design.

Here the spindle nut 47 is completely accommodated in the bore of the piston 46 and secured there by means of the serrated ring 54. The spindle 43 has two parts. It comprises a main part 55, on the surface of which—as described above in connection with FIG. 2—a steep thread is formed, and an end piece 56 screwed to the main part 55. As far as the bearing of the spindle 43 is concerned, here the (not shown) inner ring of a roller bearing 57 is fixed to the spindle 43 in the transition region between the main part 55 and the end piece 56, between a first shoulder 58 provided on the main part 55 and a second shoulder 59 provided on the end piece 56. With regard to the precise and clearance-free support of the spindle 43 in the axial direction and in the radial direction, the roller bearing 57 is configured as a double row ball bearing running under oil. Its outer ring (also not shown) is disposed in a bearing insert 60, which in turn is inserted into the bore of the base part 29 and sealed off from it by means of the sealing ring 61. The bearing insert 60 is sealed against the end piece 56 of the spindle 43 by means of the sealing ring 62. The composite of roller bearing 57 and bearing insert 60 is stayed against the washer 64 by means of the serrated ring 63, which in turn is supported by the shoulder 65 of the bore.

In the region of the end piece 56 passing through the washer 64 the rotary part 67 of the sensor (encoder) 48 is fixed with the interposition of a sleeve 66, namely secured by means of grub screws (not shown). The electronic evaluation circuit 68 can also be seen in FIG. 4, and it is disposed in the receptacle space 69 in the switching plate 35. The signal interface 72, configured as contact socket 71, is attached to the cover 70 which closes it. The electronic evaluation circuit 68 is connected via the signal line 73 to the stationary part 74 of the transducer 48.

The spring chamber 16 is sealed at the end with a special seal, gas-tight even against high gas pressures. For this purpose, the seal has a plug 76 inserted into the cylinder tube 23 and sealed against its inner wall by means of sealing rings 75, into which a filling connection 77 serving to fill the spring chamber 16 (or the gas chamber 18) with spring gas is integrated. The closure cover 24, which fixes the plug 76 in the cylinder tube 23, has an opening 78, which provides access to the filling connection 77, so that the plug 76 is only overlaid by the closure cover at the edge. The filling connection 77 is characterized by a two-stage sealing. A check valve 79, for which the insert 81 pressed into the filling nozzle 80 is only partially indicated, forms a primary sealing element 82. And a secondary sealing element 83 is formed by a screw plug 84. The function of the hydraulic adjuster 10 benefits from this particularly reliable sealing, because the precise adjustment of the gas pressure in the spring chamber 16 (and the maintenance of the set gas pressure) is a decisive factor in adapting the hydraulic adjuster to the respective application environment. A filling connection comparable to the gas side is provided on the oil side 85, not shown in FIG. 4.

Figure 5:
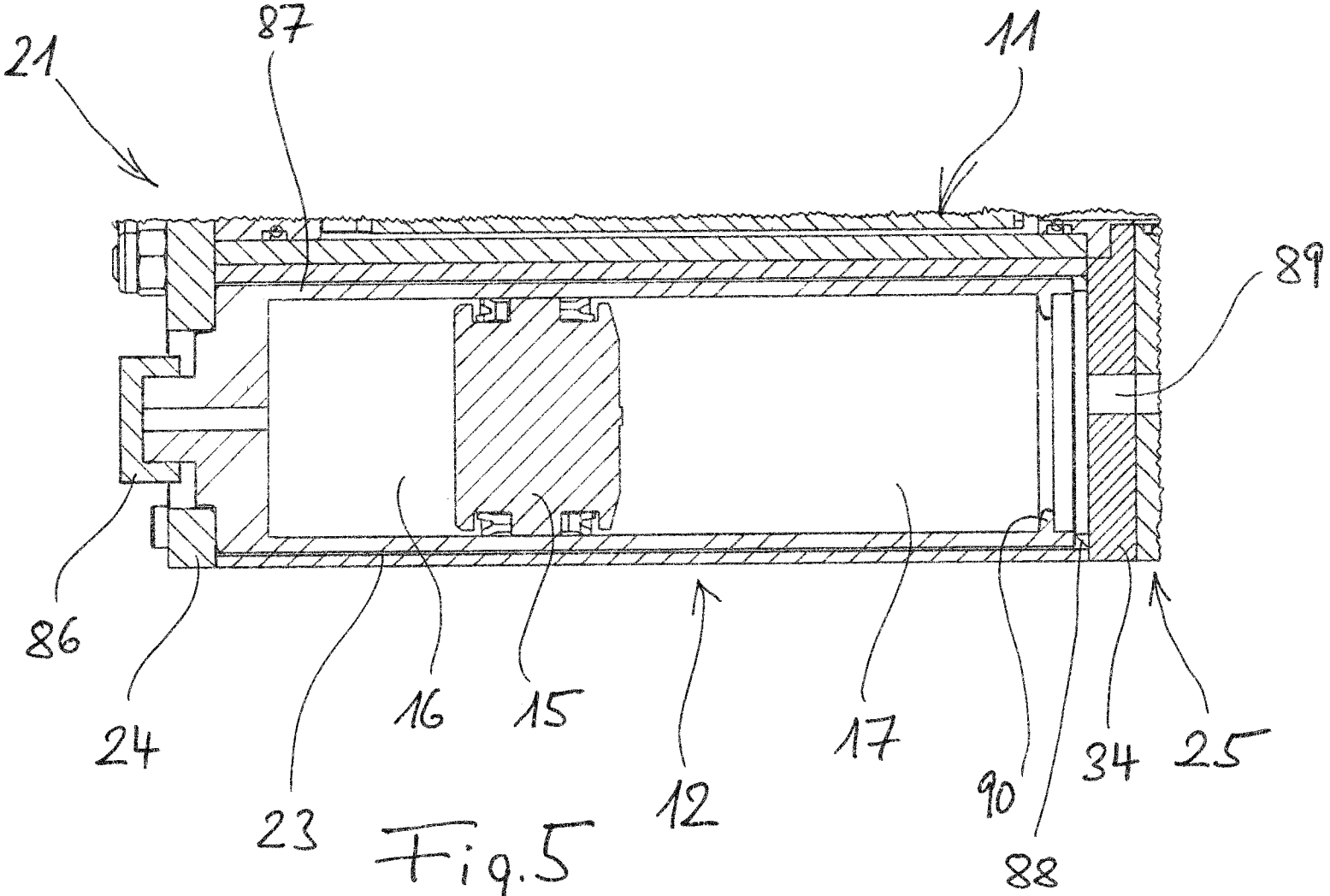
FIG. 5 is a cross section of a hydraulic adjuster modified from the one shown in FIG. 4.

The third example illustrated in FIG. 5 corresponds to the basic design features of FIGS. 2 and 4, so that reference is made to the previous explanations in order to avoid repetitions. In particular, cylinder assembly 21 in turn comprises an extruded double-tube profile in which the cylinder-piston unit 11 is accommodated in a tubular cavity. The hydraulic accumulator 12 comprises, as a main difference compared to the design example according to FIG. 4, a gas spring cartridge 87, which is prefilled at the factory and tightly sealed by means of a closure 86, which is accommodated in the other tubular cavity of the double-tube profile and realizes the gas spring. This is clamped between the two closure covers 24 and 25 in such a way that the flat seal 88 provides a frontal seal against the sealing cap 25, i.e. its end plate 34, as in the case of the guide bushing of the hydraulic accumulator 12 of the second embodiment example shown in FIG. 4. The connection 89 of the hydraulic chamber 17 made in the respective closure cover 25 is also shown here, as is the stop ring 90 for the piston 15.

The invention claimed is:

1. A fairground ride passenger unit comprising:

a passenger space; and a passenger restraint device comprising;

a position-adjustable restraint element; and a lockable hydraulic adjuster acting on the position-adjustable restraint element, the lockable hydraulic adjuster having a cylinder-piston unit and a hydraulic accumulator;

the hydraulic accumulator and the cylinder-piston unit forming a structural unit defining an integrated cylinder assembly, a cylinder of the cylinder-piston unit and a cylinder of the hydraulic accumulator being arranged next to and parallel to each other, the integrated cylinder assembly having end faces and a common closure cover on each end face.

2. The passenger unit according to claim 1, wherein the integrated cylinder assembly comprises a portion of an extruded double-tube profile.

3. The passenger unit according to claim 1, further comprising a switching plate with a line and valve arrangement hydraulically interconnecting the hydraulic accumulator with the cylinder-piston unit and an electrical switching interface provided on one of the end faces of the integrated cylinder assembly.

4. The passenger unit according to claim 3, wherein the hydraulic accumulator comprises a spring accumulator with a hydraulic space and a spring space, the hydraulic space of the hydraulic accumulator being arranged adjacent to the switching plate and the spring space of the hydraulic accumulator being arranged remote from the switching plate.

5. The passenger unit according to claim 4, wherein the spring space comprises a gas chamber which is filled with a spring gas, a plug closing the gas chamber, the plug inserted into the cylinder of the cylinder-piston unit and having an integrated filling connection for filling the gas chamber with spring gas.

6. The passenger unit according to claim 5, wherein the filling connection has a two-stage sealing.

7. The passenger unit according to claim 3, wherein the cylinder-piston unit comprises a differential cylinder and, in an unlocked floating position, both a piston working space and the piston rod working space of the differential cylinder are pressurized by the hydraulic accumulator via the line and valve arrangement.

8. The passenger unit according to claim 7, wherein the line and valve arrangement comprises a non-return valve which, in a safety position, permits flow from the piston working space of the differential cylinder to the piston rod working space thereof but prevents flow in an opposite direction.

9. The passenger unit according to claim 7, wherein the line and valve arrangement comprises a check valve arrangement which, in a blocking position, locks hydraulic fluid in the differential cylinder when the piston rod of the differential cylinder is extended.

10. The passenger unit according to claim 1, wherein the lockable hydraulic adjuster comprises a piston position sensor assigned to the cylinder-piston unit.

11. The passenger unit according to claim 10, wherein the piston position sensor has a spindle which extends parallel to a cylinder axis of the cylinder-piston unit and which is mounted so as to be axially fixed but rotatable relative to the cylinder of the cylinder-piston unit, the spindle having a threaded portion with a steep thread extending into a cavity of the piston and/or of the piston rod, the spindle interacting with a corresponding spindle nut arranged on the piston or the piston rod respectively.

12. The passenger unit according to claim 11, wherein the spindle is constructed in two parts with a main part having the threaded portion and an end piece connected thereto.

13. The passenger unit according to claim 12, wherein an inner ring of a rolling bearing running under oil is fixed to the spindle in a transition region between main part and end piece.

14. The passenger unit according to claim 13, wherein an outer ring of the roller bearing is disposed in a bearing insert which in turn is inserted into a bore of a bottom part of the cylinder of the cylinder-piston unit, the bearing insert being sealed by means of two sealing rings with respect to the bore of the bottom part accommodating it and with respect to the end piece of the spindle.

15. The passenger unit according to claim 10, wherein the adjuster comprises an electronic evaluation circuit communicating with the piston position sensor.

16. The passenger unit according to claim 10, wherein the adjuster comprises an operating data memory communicating with the piston position sensor.

* * * * *